US008753713B2

(12) United States Patent
Clark et al.

(10) Patent No.: US 8,753,713 B2
(45) Date of Patent: Jun. 17, 2014

(54) JETTING DISPENSER AND METHOD OF JETTING HIGHLY COHESIVE ADHESIVES

(75) Inventors: Justin A. Clark, Sugar Hill, GA (US); Wesley C. Fort, Cumming, GA (US); Mark A. Gould, Gainesville, GA (US); William M. Ridge, Cumming, GA (US); Laurence B. Saidman, Duluth, GA (US); Leslie J. Varga, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 167 days.

(21) Appl. No.: 13/151,918

(22) Filed: Jun. 2, 2011

(65) Prior Publication Data

US 2011/0300295 A1 Dec. 8, 2011

Related U.S. Application Data

(60) Provisional application No. 61/351,856, filed on Jun. 5, 2010.

(51) Int. Cl.
*B05D 5/10* (2006.01)

(52) U.S. Cl.
USPC ..... 427/208.2; 427/207.1; 427/208.6

(58) Field of Classification Search
CPC .. B05C 5/0291; B05C 5/0216; B05C 5/0225; B05C 5/02; B05C 5/001; B05C 11/1034
USPC ..... 427/207.1, 208, 208.2, 208.4, 208.6
See application file for complete search history.

(56) References Cited

U.S. PATENT DOCUMENTS

| | | | |
|---|---|---|---|
| 4,967,933 | A | 11/1990 | Maiorca et al. |
| 5,052,338 | A | 10/1991 | Maiorca et al. |
| 5,110,615 | A | 5/1992 | Maiorca et al. |
| 5,320,250 | A | 6/1994 | La et al. |

(Continued)

FOREIGN PATENT DOCUMENTS

| | | | |
|---|---|---|---|
| DE | 10150231 | A1 | 6/2002 |
| JP | 2004356128 | A | 12/2004 |
| WO | 9718054 | A1 | 5/1997 |

OTHER PUBLICATIONS

Nordson Asymtek, "DispenseJet DJ-100 LC Jet", product brochure, published May 6, 2011.

(Continued)

*Primary Examiner* — Michael Cleveland
*Assistant Examiner* — Xiao Zhao
(74) *Attorney, Agent, or Firm* — Wood, Herron & Evans LLP

(57) ABSTRACT

Jetting dispensers and methods of non-contact dispensing a hot melt adhesive onto a substrate. The method may include jetting a plurality of droplets of the hot melt adhesive from a nozzle outlet toward the substrate in a direction of travel. Each droplet has a droplet length approximately aligned with the direction of travel and a droplet width shorter than the droplet length. The jetting is controlled such that each of the droplets does not collapse into a spherical-shaped droplet during flight from the nozzle outlet to the substrate. The nozzle outlet may be heated to a first temperature, and the method may further include rapidly heating each droplet of the hot melt adhesive to a second temperature higher than the first temperature upon release from the nozzle outlet.

13 Claims, 7 Drawing Sheets

(56) References Cited

U.S. PATENT DOCUMENTS

| | | | | |
|---|---|---|---|---|
| 5,465,879 | A | 11/1995 | La et al. | |
| 5,505,777 | A | 4/1996 | Ciardella et al. | |
| 5,711,989 | A | 1/1998 | Ciardella et al. | |
| 5,747,102 | A | 5/1998 | Smith et al. | |
| 6,173,864 | B1 | 1/2001 | Reighard et al. | |
| 6,261,367 | B1 | 7/2001 | Donges | |
| 6,270,019 | B1 | 8/2001 | Reighard | |
| 6,315,330 | B1 | 11/2001 | Byerly | |
| 6,390,709 | B1 | 5/2002 | Zerebecki et al. | |
| 6,719,846 | B2 | 4/2004 | Nakamura et al. | |
| 6,863,225 | B2 | 3/2005 | Nakamura | |
| 7,414,532 | B2 | 8/2008 | Goehlert et al. | |
| 7,762,088 | B2 | 7/2010 | Fiske et al. | |
| 7,785,667 | B2 | 8/2010 | Quinones et al. | |
| 7,900,800 | B2 | 3/2011 | Hassler, Jr. et al. | |
| 7,939,125 | B2 | 5/2011 | Abernathy et al. | |
| 2002/0083895 | A1 | 7/2002 | Nakamura et al. | |
| 2005/0001869 | A1 | 1/2005 | Abernathy et al. | |
| 2005/0082670 | A1 | 4/2005 | Quinones et al. | |
| 2006/0029724 | A1 | 2/2006 | Babiarz et al. | |
| 2006/0157517 | A1 | 7/2006 | Fiske et al. | |
| 2006/0238354 | A1 | 10/2006 | Goehlert et al. | |
| 2007/0000603 | A1 | 1/2007 | Babiarz et al. | |
| 2007/0069041 | A1 | 3/2007 | Quinones et al. | |
| 2007/0102539 | A1 | 5/2007 | Riney | |
| 2007/0145164 | A1 | 6/2007 | Ahmadi et al. | |
| 2007/0164089 | A1 | 7/2007 | Gaugler | |
| 2008/0149691 | A1 | 6/2008 | Fujii | |
| 2008/0164335 | A1 | 7/2008 | Quinones et al. | |
| 2008/0302470 | A1* | 12/2008 | Sumita et al. | 156/241 |
| 2009/0078720 | A1 | 3/2009 | Abernathy et al. | |
| 2009/0095825 | A1 | 4/2009 | Ahmadi et al. | |
| 2009/0101669 | A1 | 4/2009 | Hassler, Jr. et al. | |
| 2009/0107398 | A1 | 4/2009 | Hassler, Jr. et al. | |
| 2009/0108033 | A1 | 4/2009 | Quinn et al. | |
| 2009/0236023 | A1 | 9/2009 | Lingier et al. | |
| 2010/0175617 | A1 | 7/2010 | Donges et al. | |
| 2010/0252576 | A1 | 10/2010 | Fiske et al. | |
| 2011/0048575 | A1 | 3/2011 | Abernathy et al. | |
| 2011/0063606 | A1 | 3/2011 | Babiarz et al. | |
| 2011/0114673 | A1 | 5/2011 | Fiske et al. | |
| 2011/0184569 | A1 | 7/2011 | Abernathy et al. | |

OTHER PUBLICATIONS

Nordson Asymtek, "DispenseJet® DJ-100 Jet", product brochure, published Sep. 17, 2008.

Nordson Asymtek "DJ-2100 DispenseJet® Valve", product brochure, published Dec. 10, 2010.

Nordson Asymtek "DispenseJet® DJ-9500 Jet", product brochure, published Sep. 15, 2008.

Nordson Asymtek "DispenseJet® DJ-9000 Jet", product brochure, published Nov. 15, 2006.

Nordson Asymtek "DJ-2200 DispenseJet", product brochure, published Dec. 7, 2004.

International Searching Authority, International Search Report and Written Opinion issued in related International application No. PCT/US2011/039048 dated Oct. 17, 2011.

International Searching Authority, International Preliminary Report on Patentability in related International application No. PCT/US2011/039048 dated Jun. 12, 2012.

IP Australia, Patent Examination Report No. 1 issued in Australian patent application No. 2011261348 dated Jul. 12, 2013.

European Patent Office, Supplementary European Search Report issued in European application No. 11790456.5 dated Mar. 26, 2014.

* cited by examiner

JETTING DISPENSER AND METHOD OF JETTING HIGHLY COHESIVE ADHESIVES

CROSS-REFERENCE TO RELATED APPLICATIONS

This application claims the priority of U.S. Provisional Patent Application Ser. No. 61/351,856, filed on Jun. 5, 2010 (now abandoned), the disclosure of which is incorporated by reference herein in its entirety.

TECHNICAL FIELD

This invention generally relates to a dispenser and a method for the non-contact dispensing of highly cohesive adhesives, and particularly to a dispenser and a method of jetting small amounts or droplets of a hot melt adhesive such as polyurethane reactive ("PUR") adhesive material.

BACKGROUND

In certain applications it is sometimes necessary to dispense liquids out of a cartridge or similar container and onto a desired target. For example, hot melt adhesives such as PUR adhesive material may be dispensed out of a syringe-like cartridge and onto a desired target. One type of conventional cartridge or syringe dispensing system for dispensing hot melt adhesives typically operates as a contact dispenser by contacting the substrate directly with the adhesive exiting the nozzle. Another type of conventional hot melt dispensing system is operable to dispense beads or large droplets of hot melt adhesive in a non-contact manner.

In some applications such as cell phone assembly, the adhesive must be accurately dispensed into small grooves having widths of 0.5 millimeters and smaller. Furthermore, these grooves are located adjacent to microelectronics components or other elements which must be isolated from the adhesive. The conventional contact syringe dispensers for hot melt adhesives are generally not effective in these applications because the nozzle outlet cannot be moved close enough in a contact dispensing process for the dispensed adhesive exiting the nozzle to contact the small grooves without also inadvertently contacting surrounding elements. To accommodate such a small target area, it is desirable to dispense small-diameter droplets of adhesive in a controlled non-contact dispensing process. However, conventional non-contact hot melt dispensing systems do not produce a small enough droplet of hot melt adhesive to fit into the small grooves.

Conventional jetting dispensers have been used for dispensing reactive two-component materials, such as epoxies. See U.S. Pat. No. 5,747,102 to Smith et al., and U.S. Pat. No. 6,253,957 to Messerly et al. "Jetting" in the context of this specification is understood to mean rapidly dispensing minute amounts of viscous material such that each jetted droplet releases from the dispenser. Conventional jetting dispensers work well for their intended purpose. However, conventional jetting dispensers have not been used effectively to dispense small or minute droplets (i.e., less than 0.5 millimeters in diameter) of highly cohesive hot melt adhesives, including PUR adhesives because the droplets passed through the valve orifice do not acquire an adequate velocity during dispensing to effectively jet. In this regard, the highly cohesive hot melt adhesive sometimes fails to release from the nozzle. As a result, the nozzle becomes blocked with adhesive that tends to rapidly cure or solidify, which renders the entire dispenser inoperable. Moreover, attempts to jet hot melt adhesive with conventional jetting dispensers has resulted in premature wear or failure of the valve needle and actuation piston as a result of the high forces required to dispense and release hot melt adhesive.

The assembly of cell phones and other electronic devices can be a relatively difficult and slow process when compared to other hot melt adhesive assembly operations. As a result, the "open time" or amount of time when the adhesive is within a temperature range conducive to forming bonds necessarily must be increased for certain electronic device assemblies. While raising the temperature of the hot melt adhesive is one option for increasing the open time, hot melt adhesives are generally highly sensitive to high temperatures and degradation of the hot melt adhesives at these higher temperatures is possible. Thus, there is a limit on how much open time can be provided for favorable bonding of components with hot melt adhesive.

There is a need, therefore, for methods and jetting dispensers that address these and other problems.

SUMMARY

In one embodiment of the invention, a method of non-contact dispensing a hot melt adhesive onto a substrate includes jetting a plurality of minute droplets of the hot melt adhesive from a nozzle outlet toward the substrate in a direction of travel. Each droplet is elongate and has a droplet length approximately aligned with the direction of travel and a droplet width shorter than the droplet length. The method also includes controlling the jetting such that each of the droplets remains elongate and does not reshape into a spherical-shaped droplet in flight between the nozzle outlet and the substrate.

Each of the droplets may be sized such that the droplet width would be 1.0 millimeter if the droplet is reshaped into a spherical shape. However, jetting the hot melt adhesive may include applying the plurality of droplets to a groove on the substrate having a groove width of 0.5 millimeters or less such that none of the hot melt adhesive flows out of the groove. The hot melt adhesive may be a polyurethane reactive (PUR) adhesive material. Jetting the hot melt adhesive may further include moving a needle through a stroke length configured to form a pressure wave sufficient to break each hot melt adhesive droplet away from the nozzle outlet.

In another embodiment of the invention, a method of non-contact dispensing a hot melt adhesive onto a substrate includes heating a dispensing system to a first temperature. The hot melt adhesive is jetted from a nozzle outlet of the dispensing system by repeatedly opening and closing a valve in the dispensing system, thereby forming a plurality of minute droplets of the hot melt adhesive. The jetting may be controlled such that each droplet of the hot melt adhesive is rapidly heated to a second temperature higher than the first temperature as each droplet releases from the nozzle outlet.

The method may further include adjusting the stroke length of a valve member of the valve so as to increase or decrease the second temperature. The method may also include rapidly cooling each jetted droplet from the second temperature to minimize degradation of the hot melt adhesive.

In another embodiment of the invention, a jetting dispenser for dispensing minute droplets of hot melt adhesive includes a dispenser module, a valve body, and a solenoid valve. The dispenser module includes a valve member with a piston portion and a needle integrally formed with the piston portion. The valve body is coupled to the dispenser module and includes a nozzle with a valve seat and a valve orifice. The solenoid valve delivers pressurized air to reciprocate the valve member towards and away from the valve seat. The needle thus repeatedly contacts the valve seat to jet minute droplets of hot melt adhesive through the valve orifice.

DETAILED DESCRIPTION

FIGS. 1-5 illustrate one embodiment of a dispenser 10 configured to dispense highly cohesive hot melt adhesive on a substrate 12 according to the present invention. For example, the dispenser 10 is a non-contact dispenser capable of jetting or rapidly dispensing minute amounts (e.g., "droplets") of PUR adhesive material or another highly cohesive thermoplastic material (hereinafter referred to collectively as hot melt adhesives) for placement in small tight locations, including but not limited to grooves in the assembly of products. The dispenser 10 can be used in the dispensing of hot melt adhesive into grooves having a groove width of 0.5 millimeters or less, as typically found in cell phone assembly or other electronics assembly. In one non-limiting example, the PUR adhesive material dispensed may be Scotch-Weld® PUR Easy Adhesive EZ17005, EZ17010, EZ17030, or EZ17060 commercially available from 3M Company of Maplewood, Minn. It will be understood that "cohesive" in this specification refers to the material tendency to stick together or remain engaged with molecules of the same material. Cohesiveness in this context is also sometimes referred to as a high elongational viscosity.

Figure 1:
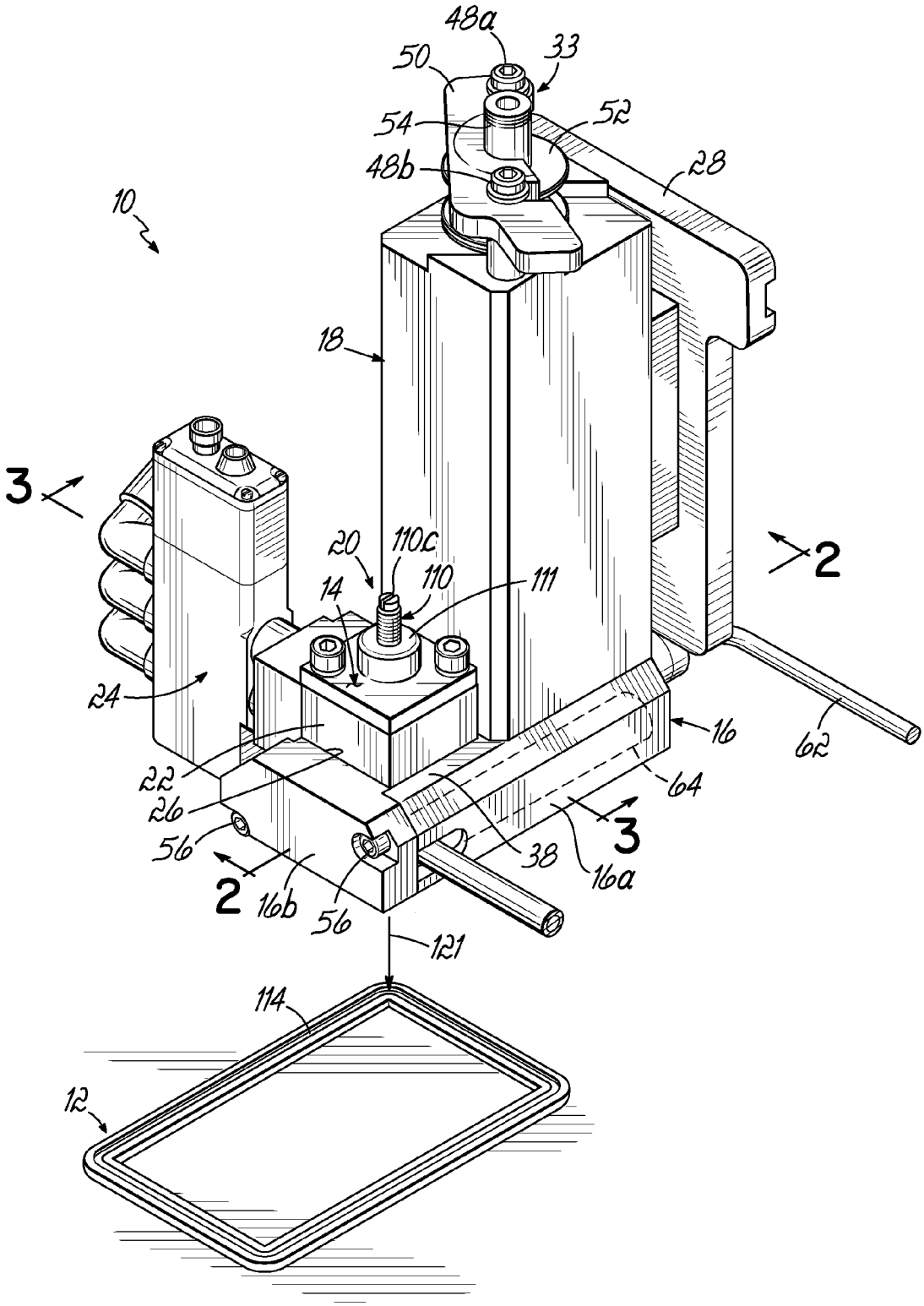
FIG. 1 is a perspective view of one embodiment of a jetting dispenser according to the present invention.

With reference to FIG. 1, the dispenser 10 includes a dispenser module 14, a heater block 16 coupled to the dispenser module 14, and an adhesive supply 18 coupled to the heater block 16. The adhesive supply 18 can be a reservoir for receiving the adhesive, or the adhesive supply 18 could receive a pre-packaged adhesive such as a cartridge or syringe of adhesive. The dispenser module 14 may include a stroke adjust assembly 20 extending into a main housing 22 coupled to the heater block 16. The main housing 22 of the dispenser module 14 may also be coupled to a solenoid valve 24 for purposes discussed in further detail below. Thus, the heater block 16, the adhesive supply 18, and the solenoid valve 24 cooperate to define a cavity 26 configured to receive and retain the dispenser module 14. The adhesive supply 18 can be mounted on a support structure 28 configured to support and move the dispenser 10 with respect to the substrate 12.

Figure 2:
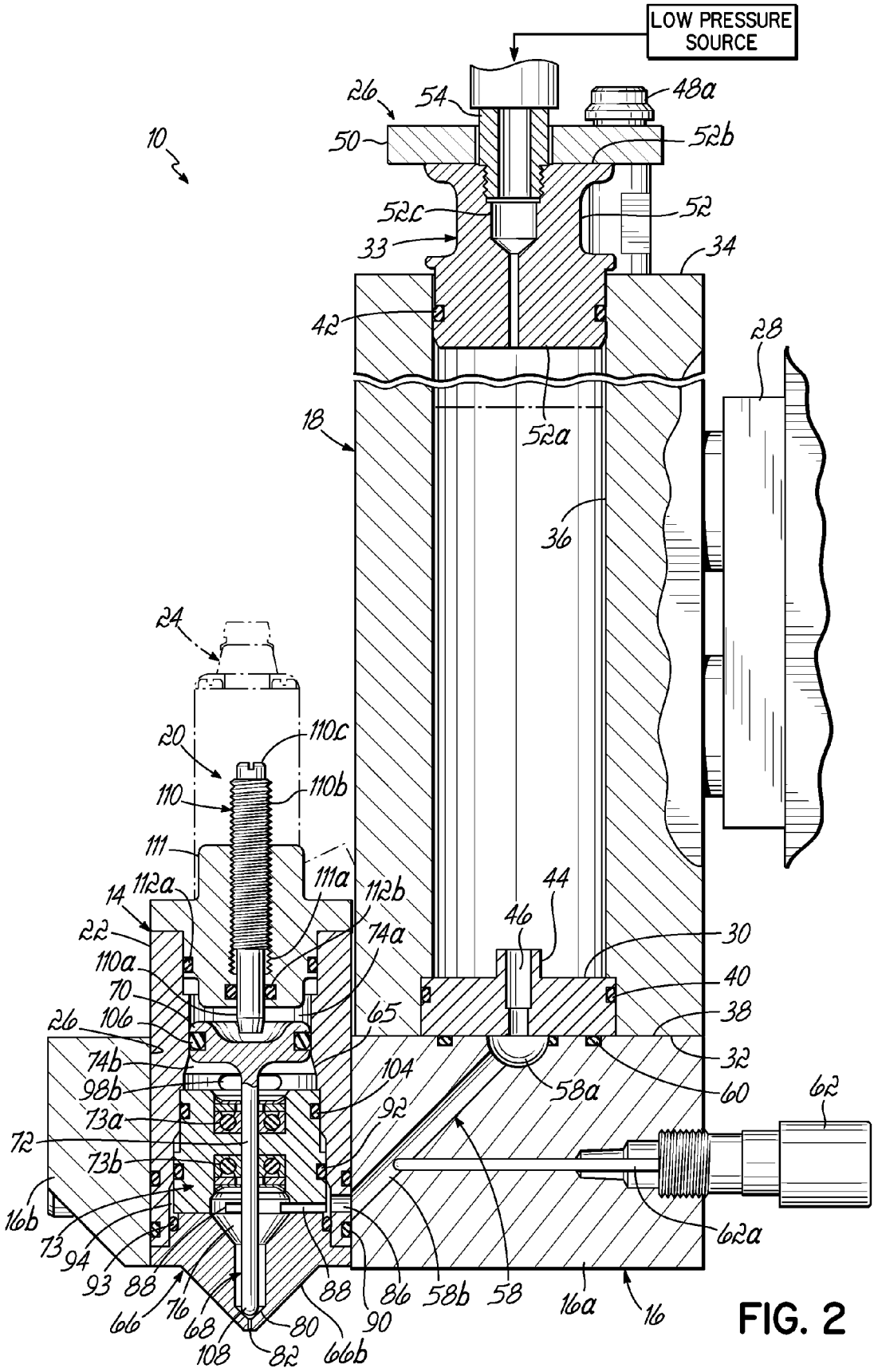
FIG. 2 is a cross-sectional side view of the jetting dispenser of FIG. 1 taken generally along line 2-2.

In the embodiment of FIG. 2, the adhesive supply 18 is adapted to receive a cartridge of adhesive (not shown). The adhesive supply 18 includes a cartridge adapter 30 at a bottom end 32, a plug assembly 33 at a top end 34, and a bore 36 for holding the cartridge or syringe of adhesive between the cartridge adapter 30 and the plug assembly 33. In alternative embodiments of the adhesive supply 18, the bore 36 may be supplied with liquid hot melt adhesive pumped into the adhesive supply 18 or with solid-state hot melt adhesive from an automatic filling or feeding system, which would then be melted and pressurized in the bore 36. When the adhesive supply 18 is coupled to the heater block 16, the bottom end 32 and the cartridge adapter 30 may abut a surface 38 of the heater block 16. A first O-ring 40 in the cartridge adapter 30 and a second O-ring 42 in the plug assembly 33 seals the bore 36 from the external surroundings of the dispenser 10. The cartridge adapter 30 includes a port 44 which may be configured to pierce an adhesive cartridge positioned in the bore 36, and an adapter passage 46 providing fluid communication between the bore 36 and the heater block 16.

After a cartridge of hot melt adhesive is placed within the bore 36, the plug assembly 33 is rotated into the closed position shown in FIGS. 1 and 2. The plug assembly 33 may include a pair of screw caps 48*a*, 48*b* extending upwardly from opposing sides of the bore 36 at the top surface 38, a rotatable locking arm 50 pivotally engaged with the first screw cap 48*a*, and a plug member 52. The plug member 52 includes a bottom end 52*a* which retains the second O-ring 42 and is configured to be inserted into the bore 36 of the adhesive supply 18. The plug member 52 also includes a top end 52*b* and an air passage 52*c* extending from the top end 52*b* to the bottom end 52*a*. The plug assembly 33 may further include an air coupling 54 engaged with the top end 52*b* of the plug member 52 by a threaded connection or the like. Pressurized air may be delivered through the air coupling 52 and the air passage 52*c* to force hot melt adhesive from the bore 36 through the cartridge adapter 30 and into the heater block 16. The locking arm 50 may be rotated into engagement with the second screw cap 48*b* and the air coupling 54 as shown in FIGS. 1 and 2 such that the locking arm 50 abuts the top end 52*b* of the plug member 52 to thereby block removal of the plug member 52 from the bore 36. When a cartridge of hot melt adhesive runs out of adhesive material, the locking arm 50 may be pivoted about the first screw cap 48*a* away from the second screw cap 48*b* and the air coupling 54 to enable removal of the plug member 52 and replacement of the cartridge. It will be understood that alternative known biasing and locking structures may be used to hold the plug member 52 in the bore 36 during operation of the dispenser 10 in other embodiments.

With reference to FIGS. 1 and 2, the heater block 16 may include a main block portion 16*a* and a cover plate 16*b* coupled to the main block portion 16*a* and the solenoid valve 24 with standard bolts 56. The cover plate 16*b* may be removed to open the cavity 26 such that the dispenser module 14 may be accessed for cleaning, repair, or replacement. The heater block 16 further includes a heater block passage 58 in the main block portion 16*a* fluidly coupling the cartridge holder 16 and the main housing 22 of the dispenser module 14. The heater block passage 58 may include a hemispherical portion 58*a* at the top surface 38 and a bore 58*b* extending from the hemispherical portion 58*a* toward the main housing 22. The bore 58*b* preferably does not include any passage elbows or curves so that the heater block passage 58 may be easily cleaned when the heater block 16 is uncoupled from the dispenser 10. The top surface 38 of the heater block 16 may include an O-ring 60 to seal the heater block passage 58 from the external surroundings of the dispenser 10.

The heater block 16 may also be configured to receive a temperature probe 62*a* disposed at the end of a temperature sensor wire 62 and a heater cartridge 64 (both shown in FIG. 1). The temperature probe 62*a* extends toward the heater block passage 58 to sense the temperature of the heater block 16 and therefore the temperature of the hot melt adhesive flowing through the dispenser 10. The temperature probe 62*a* is a conventional sensor such as a nickel-based sensor. A conventional heater cartridge 64 (shown in FIG. 3) is configured to deliver heat energy to the hot melt adhesive through the heater block 16 as well as to the dispenser module 14 and the adhesive supply 18 coupled to the heater block 16. In an exemplary operation, the heater cartridge 64 can be controlled to maintain the dispenser module 14, the heater block 16, and the adhesive supply 18 within a desired operating temperature range, such as from about 225 degrees Fahrenheit to about 275 degrees Fahrenheit. In this regard, the dispenser module 14, heater block 16, and the adhesive supply 18 are configured to transfer heat energy from the heater cartridge 64 such that a separate heating element on the dispenser module 14 is not required. This operating temperature maintains the hot melt adhesive in a molten state throughout the dispensing process.

Figure 3:
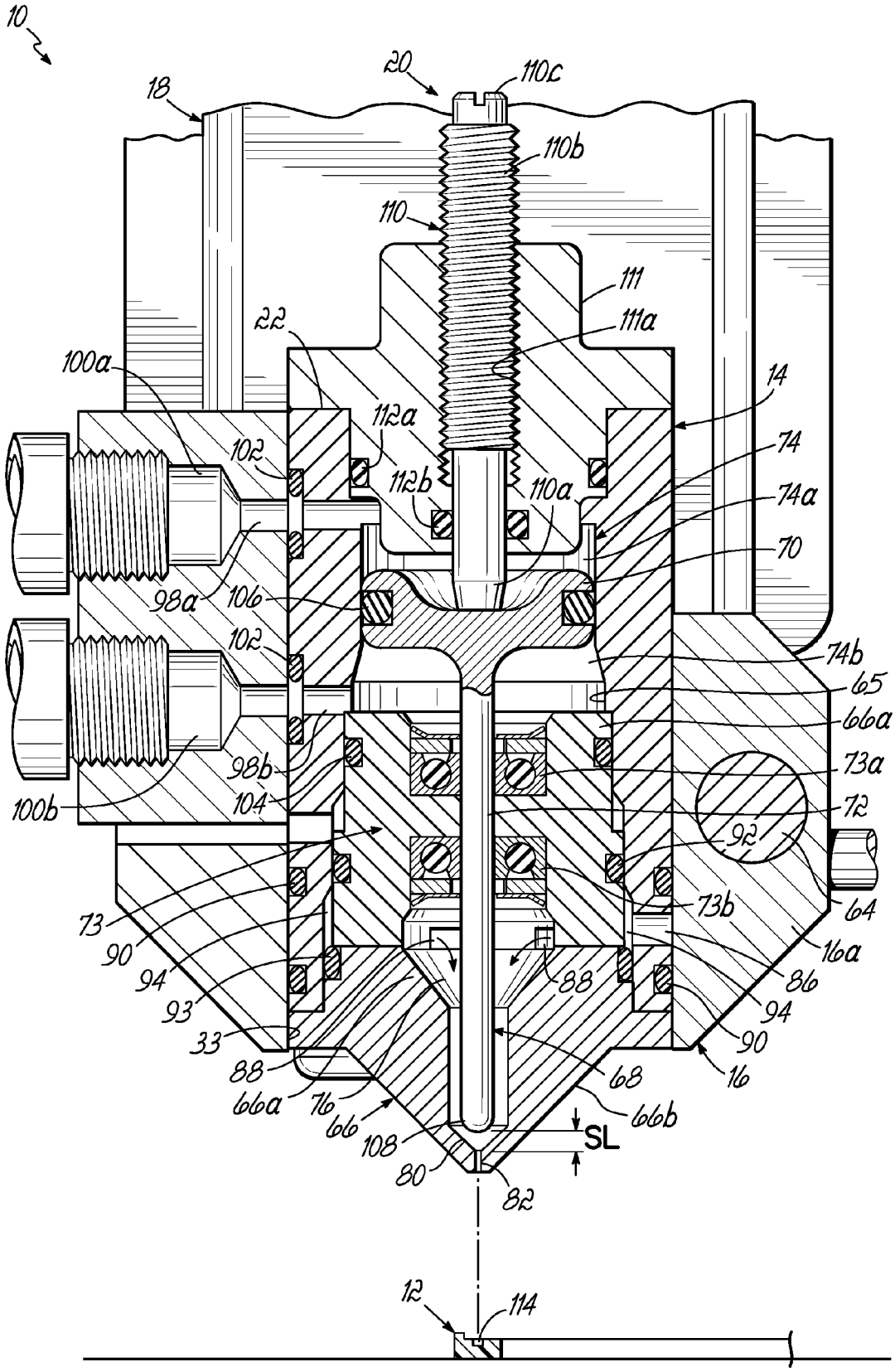
FIG. 3 is a cross-sectional front view of the jetting dispenser of FIG. 1 taken generally along line 3-3.

With further reference to FIGS. 2 and 3, the main housing 22 of the dispenser module 14 includes a bore 65 and a valve member 68 partially extending through the bore 65. A valve body 66 may be partially inserted into the bore 65 of the main housing 22 below the stroke adjust assembly 20. The valve body 66 includes an upper portion 66*a* extending into the bore 65 and a nozzle 66*b* projecting from the upper portion 66*a*. Further details of the valve body 66 are described in detail below. The valve member 68 includes a piston portion 70 and needle 72 formed integrally with the piston portion 70. The valve member 68 may be formed from stainless steel. The integral or unitary construction of the piston portion 70 and the needle 72, which are formed a single-piece of material and function as a single article, reduces the likelihood that the high forces and accelerations applied to the valve member 68 during the jetting of hot melt adhesive will shear or break portions of the valve member 68, such as at the interface between the piston portion 70 and the needle 72.

The dispenser module 14 also includes a seal pack 73 inserted into the bore 65 of the main housing 22 between the piston portion 70 of the valve member 68 and the upper portion 66*a* of the valve body 66. The seal pack divides the bore 65 of the main housing 22 into a pneumatic piston chamber 74 adapted to receive the piston portion 70 and an adhesive chamber 76 adjacent to the valve body 66 and adapted to receive hot melt adhesive and the needle. The seal pack 73 includes an upper dynamic seal member 73*a* and a lower dynamic seal member 73*b*, each of which receives the needle 72 there through. The dynamic seal members 73*a*, 73*b* maintain fluid separation between pressurized air in the piston chamber 74 and hot melt adhesive in the adhesive chamber 76. The seal pack 73 is held in position within the bore 65 by the upper portion 66*a* of the valve body 66, which may be retained within the bore 65 by threaded engagement, an external clamp, or any other known method of coupling a valve body 66 to a dispenser module 14.

The valve body 66 may include a valve seat 80 at the nozzle 66*b* and a valve orifice 82 in fluid communication with the adhesive chamber 76. The valve body 66 and therefore the valve seat 80 are typically formed from tool steel such that heat is transferred readily to the hot melt adhesive and to increase impact forces described in further detail below. Similarly, the main housing 22 is formed from stainless steel in the illustrated embodiment of the dispenser module 14. However, it will be understood that the main housing 22 may alternatively be formed from Teflon coated aluminum, brass, or another material having a high transmission of heat energy from the heater cartridge 64 to the hot melt adhesive.

The main housing 22 further includes an inlet port 86 in fluid communication with the source of adhesive. The seal pack 73 further includes at least one inlet passage 88 adjacent to the upper portion 66*a* of the valve body 66 and in fluid communication with the inlet port 86 of the main housing 22 and the adhesive chamber 76. Thus in the illustrated embodiment, hot melt adhesive flows from the bore 36 through the heater block passage 58, the inlet port 86, and the at least one inlet passage 88 to the adhesive chamber 76, where the hot melt adhesive can then be dispensed through the valve orifice 82. A pair of sealing O-rings 90 may be disposed between the heater block 16 and the main housing 22. Another sealing O-ring 92 may be disposed between the main housing 22 and the seal pack 73 above the at least one inlet passage 88, and yet another sealing O-ring 93 may be disposed between the main housing 22 and the upper portion 66*a* of the valve body 66. These sealing O-rings 90, 92, 93 ensure that the fluid pathway from the heater block 16 to the adhesive chamber 76 remains sealed from the external surroundings of the dispenser 10. The illustrated embodiment of the seal pack 73 includes multiple inlet passages 88 and an annular passage 94 defined between the seal pack 73 and the main housing 22 so as to provide fluid communication between the inlet port 86 and the multiple inlet passages 88, but it will be understood that only one inlet passage 88 without an annular passage 94 could be provided in alternate embodiments within the scope of this invention.

The pneumatic piston chamber 74 in the main housing 22 is divided into an upper piston chamber 74*a* and a lower piston chamber 74*b* by the piston portion 70 of the valve member 68. The upper piston chamber 74*a* may be bounded by a blocking member formed by the bottom end 110*a* of a rod 110 of the stroke adjust assembly 20 (described in further detail below), while the lower piston chamber 74*b* may be bounded by the seal pack 73 and the upper seal member 73*a*. The main housing 22 further includes an upper air inlet 98*a* in fluid communication with the upper piston chamber 74*a* and an upper air outlet 100*a* of the solenoid valve 24. Likewise, the main housing 22 also includes a lower air inlet 98*b* in fluid communication with the lower piston chamber 74*b* and a lower air outlet 100*b* of the solenoid valve 24. The piston chamber 74 and the upper and lower air inlets 98*a*, 98*b* may be sealed from the external surroundings of the dispenser 10 by a pair of O-rings 102 located between the main housing 22 and the solenoid valve 24 and another O-ring 104 positioned between the main housing 22 and the valve body 66. Furthermore, the piston portion 70 may include a piston seal 106 configured to seal the upper piston chamber 74*a* from the lower piston chamber 74*b*.

Figure 4A:
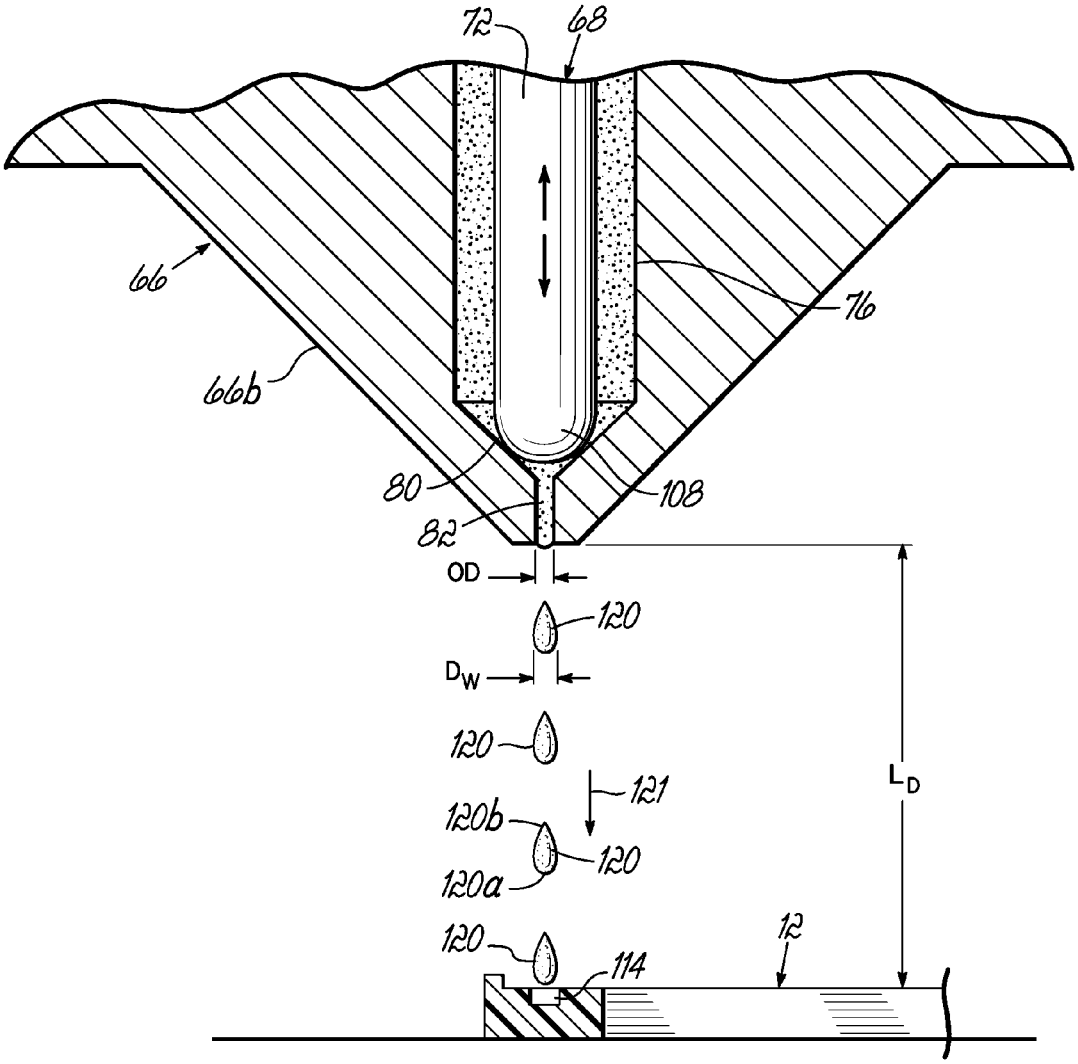
FIG. 4A is a cross-sectional front view of the jetting dispenser of FIG. 1 during dispensing of hot melt adhesive onto a substrate.

The solenoid valve 24 is a known air valve that alternatively supplies pressurized air at about 60-100 psi to the upper piston chamber 74*a* and the lower piston chamber 74*b* to force the piston 70 and needle 72 to move between a retracted position shown in FIG. 3 and an extended position shown in FIG. 4A. As a result, a ball-shaped end 108 of the needle 72 of the valve member 68 comes into and out of engagement with the valve seat 80, thereby opening and closing the valve orifice 82 repeatedly. It will be understood that the end 108 of the needle 72 of the valve member 68 may be formed with a different shape than the ball shape illustrated in this embodiment of the dispenser 10. Additionally, although the movement of the valve member 68 is controlled pneumatically using the piston 70 and the solenoid valve 24 in the illustrated embodiment, other embodiments of the dispenser 10 may include alternative devices for actuating reciprocating movement of the valve member 68, including but not limited to an electric motor and armature.

The stroke adjust assembly 20 of the illustrated embodiment includes an internal rod 110 having a lower end 110*a* extending into the upper piston chamber 74*a*. It will be understood that the lower end 110*a* of the rod 110 may be formed from a material configured to damp the repeated impacts of the piston 70 against the stroke adjust assembly 20, and the hot melt adhesive also slightly damps the impact between the ball-shaped end 108 and the valve seat 80. However, these damping forces do not prevent the dispenser 10 from jetting minute droplets of hot melt adhesive from the adhesive chamber 76. The stroke adjust assembly 20 may also include a module cap 111 inserted at least partially into the bore 65 of the main housing 22 above the piston chamber 74. The module cap 111 includes an internally threaded bore 111*a* adapted to engage a central threaded portion 110*b* of the rod 110. A first sealing O-ring 112*a* is positioned between the module cap 111 and the main housing 22, and a second sealing O-ring 112*b* is positioned between the rod 110 and the module cap 111 below the internal threads of the bore 111*a*. These sealing O-rings 112*a*, 112*b* prevent pressurized air from leaking out of the piston chamber 74 to the external environment around the dispenser 10. The internal rod 110 extends beyond the module cap 111 to a drive head 110*c* which may be rotated to move the rod 110 upwardly or downwardly within the module cap 111 and the piston chamber 74.

In the retracted position of the valve member 68 shown in FIG. 3, the lower end 110*a* of the rod 110 abuts the piston portion 70 to stop upward movement of valve member 68. Consequently, movement of the rod 110 caused by rotation of the drive head 110*c* is operable to modify the total stroke length (shown as SL in FIG. 3) of the valve member 68. In the illustrated embodiment, the stroke length SL is adjustable between about 1.5 millimeters and about 2.0 millimeters. The maximum stroke length SL (approximately 2.0 millimeters) is approximately four times longer than the maximum stroke length of conventional jetting dispensers (which are not used to dispense hot melt adhesive as described above). The stroke length SL of the valve member 68 enables full release of hot melt adhesive from the nozzle 66*b* during dispensing cycles, and further increases the application temperature of the hot melt adhesive to increase the open time available for favorable bonding with the hot melt adhesive, as explained in further detail below.

With reference to FIG. 4, the valve orifice 82 may define an outlet diameter OD of about 0.2 millimeters to about 0.3 millimeters. This range of outlet diameters OD is larger than outlets of conventional jetting dispensers (which are not used to dispense hot melt adhesive as described above) and further encourages the release of hot melt adhesive from the nozzle 66*b*. To this end, the outlet diameter OD of the valve orifice 82, the pressure wave formed by the movement of the valve member 68 through the stroke length SL, and the impact of the ball-shaped end 108 against the valve seat 80 are collectively sufficient to force highly cohesive hot melt adhesive to completely break away from the valve orifice 82 to form an elongate droplet 120. Consequently, the jetting dispenser 10 of the current embodiment can successfully jet minute amounts of hot melt adhesive, including PUR adhesive material, to fly from the nozzle 66*b* toward a substrate 12 along a direction of travel indicated by arrow 121. Thus, as the dispensing cycle is repeated, the hot melt adhesive does not build up to block the nozzle 66*b* and is therefore effectively jetted.

The dispenser 10 controls the dispensed droplets 120 of hot melt adhesive to elongate or stretch out at the breakaway point from the nozzle 66*b* as a result of the jetting process. In this regard, the dispensed droplets 120 define an elongated teardrop-type shape having a wider leading end 120*a* and a narrower tail end 120*b* (see FIG. 5). Each dispensed droplet 120 defines a droplet length $D_L$ from the leading end 120*a* to the tail end 120*b* as defined approximately along the direction of travel 121. Each dispensed droplet 120 also defines a droplet width $D_W$ defined in a transverse direction from the direction of travel 121, the droplet width $D_W$ being smaller than the droplet length $D_L$. Even though the nozzle 66*b* is spaced from the substrate 12 by a dispensing height $L_D$, the high cohesiveness of the hot melt adhesive assists in substantially maintaining the shape and orientation of the dispensed droplets 120 as the droplets 120 travel along the dispensing height $L_D$.

Figure 4B:
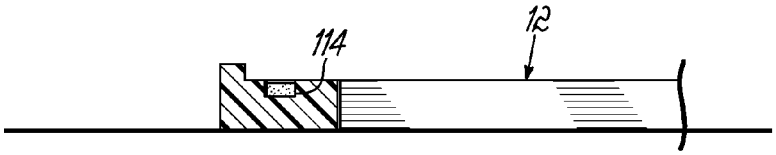
FIG. 4B is a cross-sectional front view of the substrate of FIG. 4A after the dispensing of hot melt adhesive.

In other words, the droplets 120 do not tend to reshape into a wider spherical-shaped droplet during the course of travel from the nozzle 66*b* to the substrate 12. The droplet width $D_W$ therefore remains generally constant during travel. Consequently, the droplet 120 of hot melt adhesive remains appropriately sized and oriented upon contacting the substrate 12 to fit into small spaces, such as a groove 114 having a groove width $W_G$ of 0.5 millimeters or less. By contrast, if the droplets 120 were to reshape into a wider spherical-shaped droplet during travel, the droplet width $D_W$ would increase to about 1.0 millimeters, which is too wide to fit into the groove 114. However, the dispenser 10 of the present embodiment elongates and controls the size of the jetted droplets 120 of hot melt adhesive so that the droplets 120 may be completely held within the groove 114 on the substrate 12 as shown in FIGS. 4B and 5.

Figure 5:
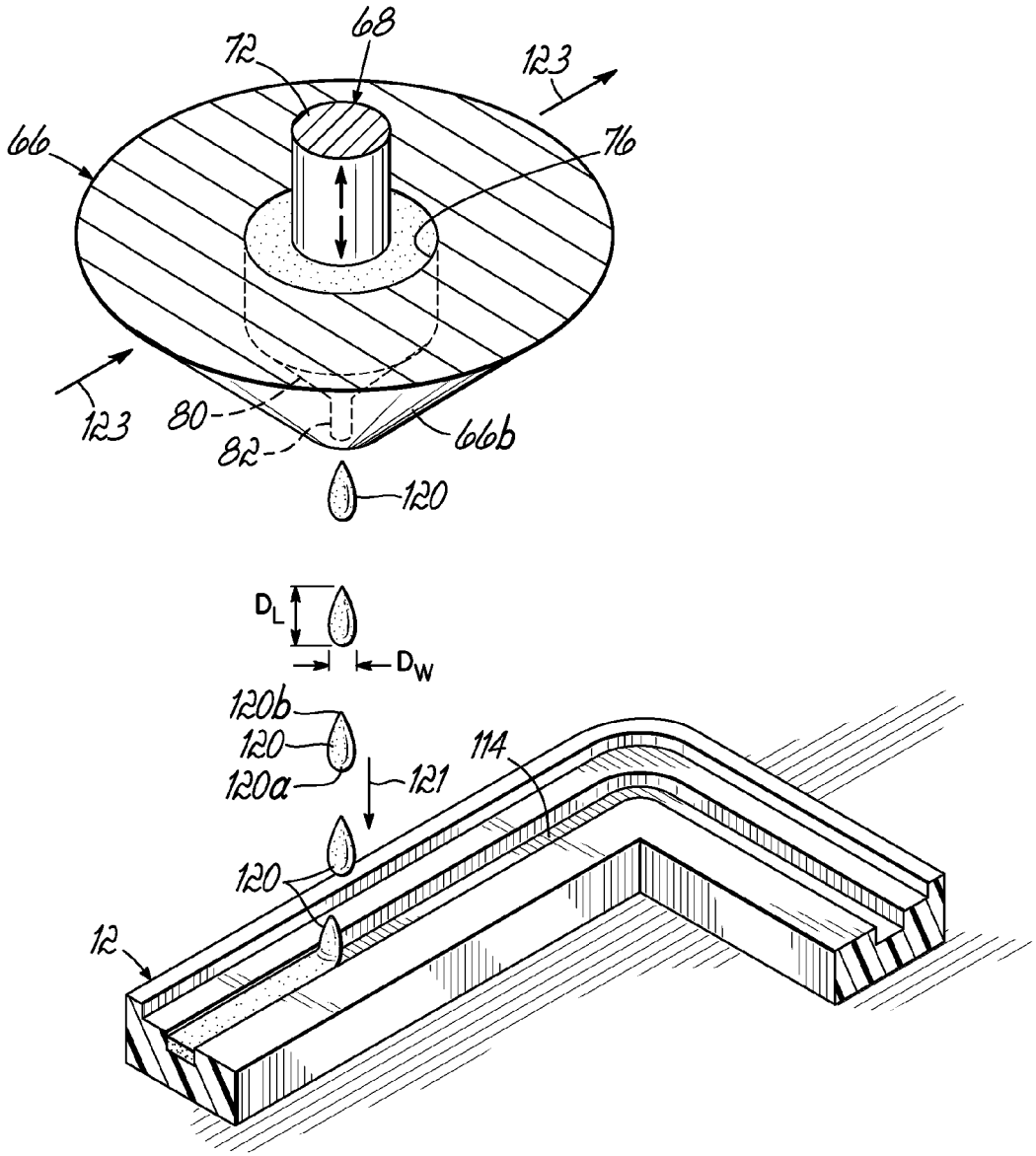
FIG. 5 is a partially cut-away perspective view of the jetting dispenser of FIG. 1 dispensing hot melt adhesive onto the substrate of FIG. 4A.

With continued reference to FIG. 5, the dispenser 10 may be moved along the length of the groove 114 in the direction of arrows 123 during jetting of the hot melt adhesive. This movement along the length of the groove 114 encourages the elongate droplets 120 to spread along the length of the groove 114 upon contacting the groove 114 instead of spreading outside the width of the groove 114. In sum, the movement of the dispenser 10 along the length of the groove 114 and the controlled elongate shape and size of dispensed droplets 120 collectively ensures that the hot melt adhesive is applied only into the groove 114.

Advantageously, the jetting dispenser 10 also consistently dispenses the same volume of hot melt adhesive in each droplet 120 throughout a day of dispensing, during which the viscosity of the hot melt adhesive can change up to 20-30%, especially in the case of PUR adhesive material. Consequently, a consistent volume of hot melt adhesive may be applied to each successive substrate 12 in a production process.

The jetting dispenser 10 also enables dispensing of the hot melt adhesive at an optimum temperature for maximizing the open time or the amount of time after application in which a favorable bond may be made with the hot melt adhesive. As described previously, the heater cartridge 64 heats the hot melt adhesive to a first temperature which is an application temperature that is less than the temperature where the hot melt adhesive begins to degrade if held at that temperature for an extended period of time. The application temperature may vary due to the differences between adhesives, the substrates to be bonded, etc. In the examples below, the application temperature was about 250 degrees Fahrenheit. The jetting dispenser 10 also advantageously produces enough shear forces on the hot melt adhesive during the jetting process to cause a rapid or instantaneous heating of the dispensed minute droplets of hot melt adhesive to a second temperature above the first temperature. An example of the rapid heating of the hot melt adhesive is further illustrated in the graphical plots shown in FIGS. 6A-6D.

Figure 6A:
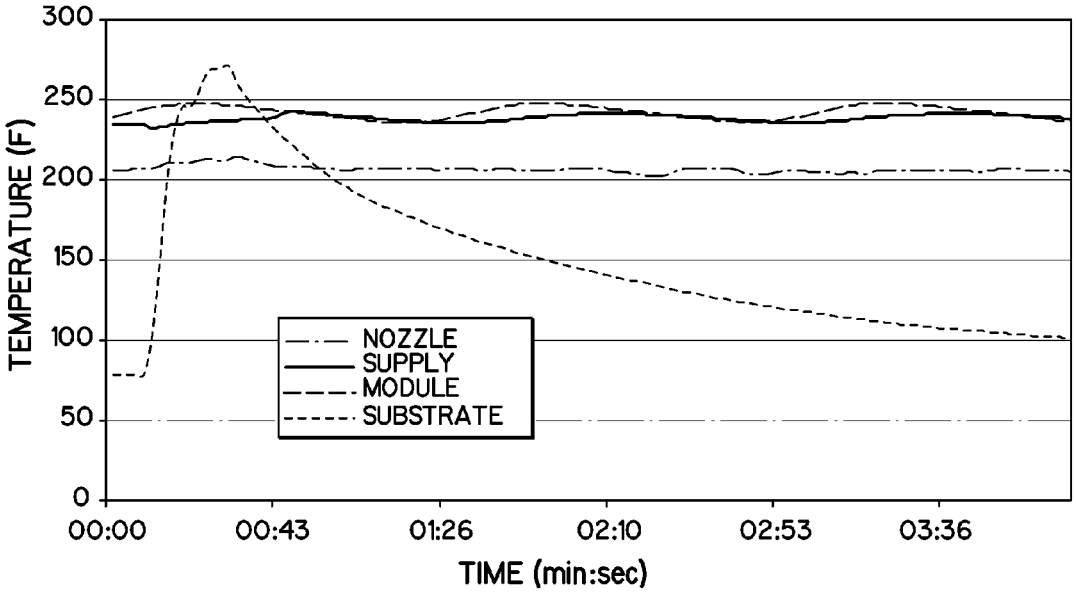
FIG. 6A is a graphical plot of the temperature of the jetting dispenser of FIG. 1 and the dispensed hot melt adhesive during an exemplary dispensing cycle with the jetting dispenser actively heated.

FIG. 6A corresponds to a pool test with a typical hot melt adhesive which has a lower cohesiveness than PUR adhesive. In this pool test, the jetting dispenser 10 continuously fired for at least 20 seconds on a stationary substrate, and the hot melt adhesive was permitted to pool over the substrate. Temperature sensors were positioned on the adhesive supply 18, on the dispenser module 14, on the nozzle 66*b*, and on the substrate 12. The heater cartridge 64 heated the dispenser module 14 to about 250 degrees Fahrenheit over the course of the pool test. As shown in FIG. 6A, the temperature measured at the nozzle 66*b* and the temperature of the dispensed hot melt adhesive on the substrate spike during the dispensing period (from approximately t=5 seconds to t=25 seconds) well above the module temperature of 250 degrees Fahrenheit. The hot melt adhesive on the substrate reached a maximum temperature of 270 degrees Fahrenheit in this pool test, but then rapidly cooled after the dispensing cycle is completed as shown in FIG. 6A.

Figure 6B:
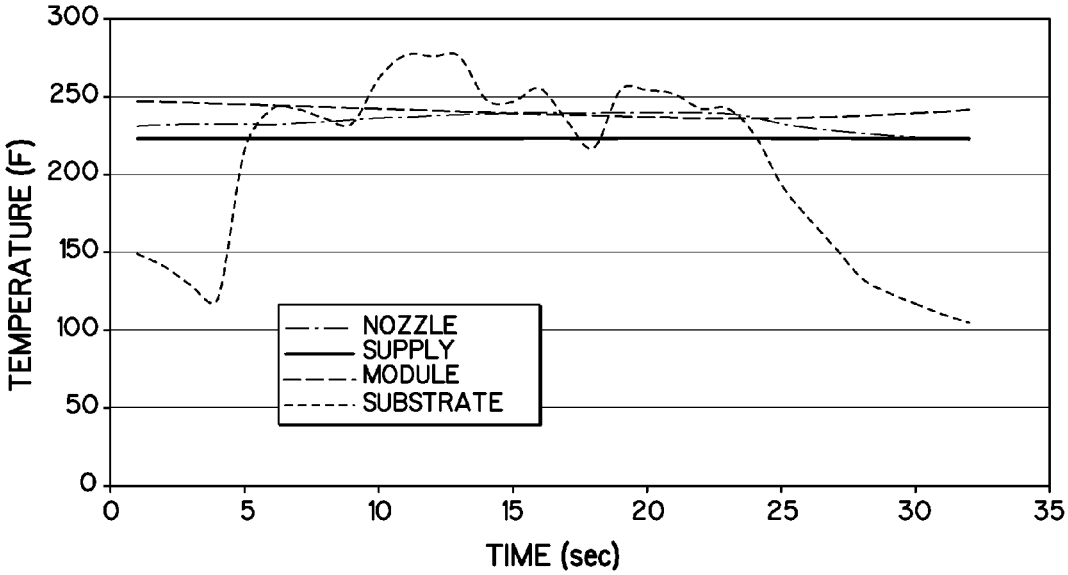
FIG. 6B is a graphical plot of the temperature of the jetting dispenser of FIG. 1 and the dispensed PUR adhesive material during an exemplary dispensing cycle with the jetting dispenser actively heated.

FIG. 6B corresponds to a pool test with a PUR adhesive material. Similar to the previous pool test, the jetting dispenser 10 continuously fired from about t=5 seconds to t=25 seconds, the heater cartridge 64 heated the dispenser module 14 to about 250 degrees Fahrenheit, and the PUR adhesive material pooled on the substrate. Once again, the rapid heating of the nozzle 66*b* and the dispensed PUR adhesive material on the substrate are illustrated during the dispensing cycle in FIG. 6B. Although the temperature sensor on the substrate recorded a noisy temperature signal, the maximum temperature of the PUR adhesive material on the substrate is 275 degrees Fahrenheit. Once again, the PUR adhesive material rapidly cooled on the substrate once the dispensing cycle is completed.

Figure 6C:
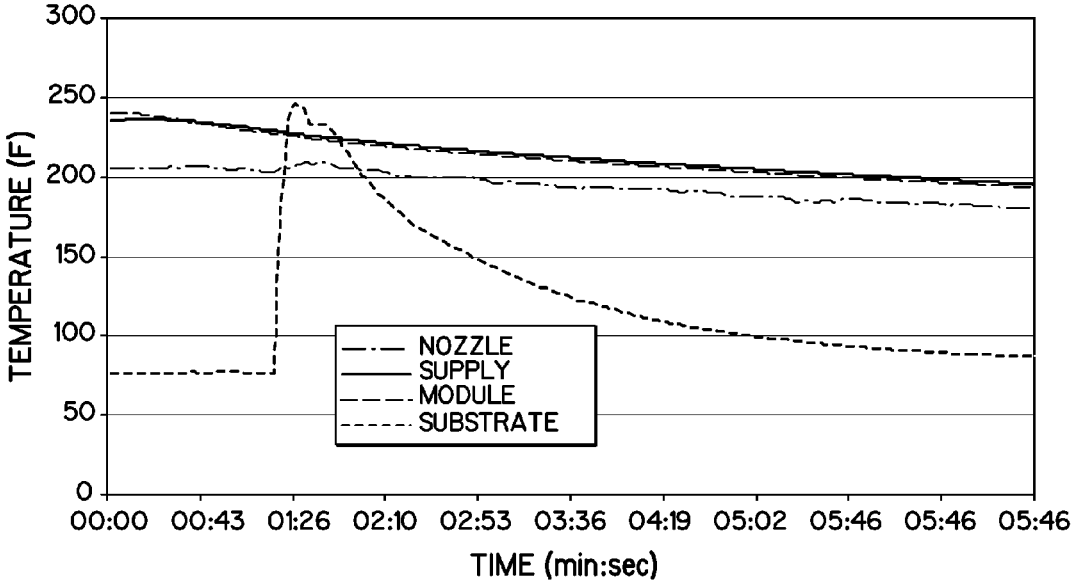
FIG. 6C is a graphical plot of the temperature of the jetting dispenser of FIG. 1 and the dispensed hot melt adhesive during another exemplary dispensing cycle with the jetting dispenser not actively heated.
Figure 6D:
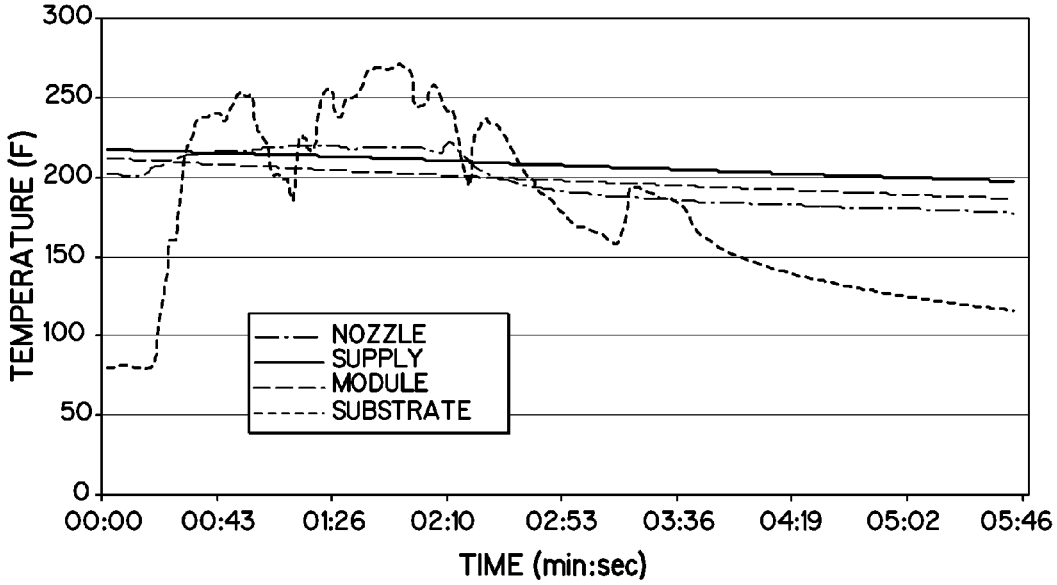
FIG. 6D is a graphical plot of the temperature of the jetting dispenser of FIG. 1 and the dispensed PUR adhesive material during another exemplary dispensing cycle with the jetting dispenser not actively heated.

FIGS. 6C and 6D correspond to alternative pool tests using the same hot melt adhesive in FIG. 6A and the same PUR adhesive material in FIG. 6B, except that the heater cartridge 64 is not actively heating the dispenser module 14 in these pool tests. Consequently, in both tests the module temperature is illustrated as falling over the course of the test because of the lack of active heating. Even without the active heating, the temperature of the nozzle 66*b* and the temperature of the dispensed adhesive on the substrate in both tests spiked well above the temperature of the dispenser module 14. As shown in FIG. 6C, the hot melt adhesive material on the substrate reached a maximum temperature of 245 degrees Fahrenheit when the temperature of the dispenser module 14 was about 225 degrees Fahrenheit. Similarly as shown in FIG. 6D, the PUR adhesive material on the substrate reached a maximum temperature of 270 degrees Fahrenheit when the temperature of the dispenser module 14 was about 210 degrees Fahrenheit.

From these pool test results, it is clear that the jetting of the hot melt adhesive does cause a rapid increase in the application temperature of the hot melt adhesive. This rapid increase in application temperature is even more pronounced with PUR adhesive material. It is believed that the increased stroke length SL of the valve member 68 causes increased frictional engagement between the needle 72 and the hot melt adhesive in the adhesive chamber 76 as well as higher impact or shearing forces applied to the hot melt adhesive when the ball-shaped end 108 contacts the valve seat 80. Each of these increased sources of heat energy permit the rapid or instantaneous significant temperature increase of a jetted minute droplet 120 above the first temperature controlled at the dispenser module 14. And because the size of the jetted droplet 120 is minute, this temperature increase (e.g., to the second temperature in the examples above) significantly increases the amount of time in which the jetted hot melt adhesive maintains a high enough temperature to form adequate bonds.

Furthermore, the temperature increase of the jetted droplets 120 may be controlled by increasing or decreasing the stroke length SL of the valve member 68. The second temperature may approach or exceed the temperature at which the hot melt adhesive begins to degrade, but the jetted droplets 120 cool quickly after release from the nozzle 66*b* and thus minimize the risk of degradation caused by staying at that temperature for extended periods of time. In this regard, the jetting dispenser 10 effectively increases the open time of the hot melt adhesive while minimizing degradation of the hot melt adhesive.

Thus, the dispenser 10 addresses many of the problems with dispensing droplets 120 of hot melt adhesive or other cohesive material into small grooves 114 on a substrate 12, such as in cell phone assemblies. The dispenser 10 is effective in jetting small droplets of the hot melt adhesives and controlling the dispensed droplets 120 such that the hot melt adhesive fits into a small groove 114. Furthermore, the dispenser 10 instantaneously heats the dispensed droplets 120 above the controlled first temperature at the dispenser module 14 such that open time is increased with minimal degradation of the hot melt adhesive.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A method of non-contact dispensing a hot melt adhesive onto a substrate, the method comprising:

jetting a plurality of minute droplets of the hot melt adhesive from a nozzle outlet toward the substrate in a direction of travel, each droplet of the hot melt adhesive being elongate and having a droplet length approximately aligned with the direction of travel and a droplet width shorter than the droplet length during flight between the nozzle outlet and the substrate, wherein the substrate includes a groove defining a groove width of 0.5 millimeters or less, each droplet of the hot melt adhesive is sized such that the droplet width would be about 1.0 millimeter if the droplet reshaped into a spherical shape, and jetting the hot melt adhesive further comprises:

applying the plurality of droplets into the groove on the substrate such that none of the hot melt adhesive flows out of the groove.

2. The method of claim 1, wherein a dispensing system jets the hot melt adhesive, the dispensing system including a valve and the nozzle outlet, and jetting the hot melt adhesive further comprises:

opening the valve to deliver the hot melt adhesive through the nozzle outlet; and closing the valve to break the hot melt adhesive away from the nozzle outlet to become one of the droplets.

3. The method of claim 2, wherein the valve includes a valve seat and a needle, and opening the valve further comprises:

withdrawing the needle from the valve seat to a retracted position through a stroke length of about 1.5 millimeters to about 2.0 millimeters.

4. The method of claim 3, wherein closing the valve further comprises:

moving the needle from the retracted position to the valve seat through the stroke length of about 1.5 millimeters to about 2.0 millimeters to form a pressure wave that breaks the hot melt adhesive away from the nozzle outlet.

5. The method of claim 1, wherein the hot melt adhesive is a polyurethane reactive (PUR) adhesive material.

6. The method of claim 1, wherein a dispensing system with the nozzle outlet jets the hot melt adhesive, the hot melt adhesive defines a degradation temperature at which the hot melt adhesive will degrade when held at that degradation temperature over time, and jetting the hot melt adhesive further comprises:

heating the dispensing system to a first temperature below the degradation temperature of the hot melt adhesive; and controlling the jetting such that each droplet of the hot melt adhesive is heated to a second temperature greater than the first temperature as each droplet releases from the nozzle outlet, the second temperature being about equal to or greater than the degradation temperature of the hot melt adhesive; and cooling each jetted droplet from the second temperature immediately after release from the nozzle outlet.

7. The method of claim 6, wherein the first temperature is within a range from about 225 degrees Fahrenheit to about 275 degrees Fahrenheit, and wherein the second temperature is at least 20 degrees Fahrenheit greater than the first temperature.

8. The method of claim 6, wherein heating each jetted droplet of the hot melt adhesive to the second temperature affects the open time of the hot melt adhesive on the substrate.

9. The method of claim 6, wherein jetting the plurality of minute droplets of the hot melt adhesive from the nozzle outlet toward the substrate in the direction of travel comprises:

repeatedly opening and closing a valve to form the minute droplets of the hot melt adhesive.

10. The method of claim 1, wherein jetting the plurality of minute droplets of the hot melt adhesive from the nozzle outlet toward the substrate in the direction of travel comprises:

repeatedly opening and closing a valve to form the minute droplets of the hot melt adhesive.

11. A method of non-contact dispensing a hot melt adhesive onto a substrate with a dispensing system including a valve and a nozzle outlet, the hot melt adhesive defining a degradation temperature at which the hot melt adhesive will degrade when held at that degradation temperature over time, the method comprising:

heating the dispensing system to a first temperature below the degradation temperature of the hot melt adhesive;

jetting the hot melt adhesive from the nozzle outlet and toward the substrate by repeatedly opening and closing the valve to form a plurality of minute droplets of the hot melt adhesive;

controlling the jetting such that each droplet of the hot melt adhesive is heated to a second temperature higher than the first temperature as each droplet releases from the nozzle outlet, the second temperature being about equal to or greater than the degradation temperature of the hot melt adhesive; and cooling each jetted droplet from the second temperature immediately after release from the nozzle outlet.

12. The method of claim 11, wherein the valve includes a valve member traveling through a stroke length, and controlling the jetting further comprises:

adjusting the stroke length to adjust the second temperature.

13. The method of claim 11, wherein the first temperature is within a range from about 225 degrees Fahrenheit to about 275 degrees Fahrenheit, and wherein the second temperature is at least 20 degrees Fahrenheit greater than the first temperature.

* * * * *